US005452517A

United States Patent [19]

Lothmann

[11] Patent Number: 5,452,517

[45] Date of Patent: Sep. 26, 1995

[54] MULTI COLOR WIRE MARKER

[75] Inventor: Werner Lothmann, Thornburg Holsworthy, England

[73] Assignee: The Whitaker Corporation, Wilmington, Del.

[21] Appl. No.: 236,279

[22] Filed: May 2, 1994

[30] Foreign Application Priority Data

May 28, 1993 [GB] Great Britain ..... 9311015

[51] Int. Cl.[6] ..... B05D 5/06

[52] U.S. Cl. ..... 33/41.4; 33/45; 118/255; 118/DIG. 21; 427/286

[58] Field of Search ..... 33/19.1, 21.1, 33/34, 41.1, 41.4, 45; 118/234, 240, 241, 255, 257, DIG. 21, 78; 400/216.1, 216.2; 427/11, 286

[56] References Cited

U.S. PATENT DOCUMENTS

| | | | |
|---|---|---|---|
| 2,428,284 | 9/1947 | Krogel | 118/DIG. 21 |
| 4,047,271 | 9/1977 | Paterson et al. | 118/234 |
| 4,387,665 | 6/1983 | Clinton | 118/DIG. 21 |
| 4,543,002 | 9/1985 | Bittner et al. | 400/216.1 |
| 5,153,025 | 10/1992 | Klebl et al. | 427/286 |

FOREIGN PATENT DOCUMENTS

| | | |
|---|---|---|
| 53-106488 | 9/1978 | Japan . |
| 58-175215 | 10/1983 | Japan . |
| 58-223212 | 12/1983 | Japan . |
| 60-105115 | 6/1985 | Japan . |
| 60-17807 | 6/1985 | Japan . |
| 60-107348 | 6/1985 | Japan . |
| 60-151906 | 8/1985 | Japan . |
| 62-263837 | 11/1987 | Japan . |

*Primary Examiner*—William A. Cuchlinski, Jr.
*Assistant Examiner*—G. Bradley Bennett
*Attorney, Agent, or Firm*—Adrian J. LaRue; Eric J. Groen

[57] ABSTRACT

A multi color wire marker comprises a base, a slideway, a carriage housing to which are mounted rollers for respectively feeding and gathering hot foil colored tape, a main ram housing and an anvil against which a wire to be marked is supported. A plurality of rollers carrying different colored tapes are mounted on the carriage housing whereby anyone of the colored tapes can be chosen to mark the wire by indexably moving the carriage housing until the appropriate tape is lying between the ram and the anvil. The ram which is heated to an adjustable temperature is then pressed against the tape which presses the wire against the anvil, the heat and pressure making colored products mounted on the tape melt off and color mark the wire.

7 Claims, 3 Drawing Sheets

MULTI COLOR WIRE MARKER

BACKGROUND OF THE INVENTION

1. Field of the Invention

This invention relates to a multi color wire marker, and in particular, for marking mono colored insulated wire with hot foil colored tape.

2. Description of the Prior Art

It is often desirable in the electric cable industry to have insulated electrical wires with specific markings that distinguish one insulated wire from another. This is especially so, if confusion is to be avoided when connecting different electrical devices with electrical conductors stemming from the same cable harness. One of the most effective means of distinguishing between wires is to mark them with different colors.

Cable harness leads are often prepared by an automated process whereby a cable making machine, for example, feeds electrical conducting wires from a barrel, cutting the various wires into their required lengths and terminating the ends by crimping to a connector or leaving the ends free. Some automated cable makers feed simultaneously from a multitude of barrels that have different colored electrical conducting wires, and there is therefore no need to mark the wire during preparation of the lead. A more cost effective way, however, of producing leads is to use a cable making machine that feeds off only one barrel of mono colored electrical conducting wire. This means however, that if distinguishable marking is required on the various wires of a lead, then some sort of marking process must be coupled to the lead maker.

There are many ways of preparing color marked leads, one common way being the use of hot foil tape, whereby a meltable colored product mounted on foil tape is deposited on the wire with heat and pressure. In presently designed color marking machines the wire is moved to the corresponding color station for marking. This movement of the wire required for marking makes it impossible for the wire to be simultaneously marked and prepared in the lead maker. Simultaneous preparation of the lead and coloring of the respective wires would be advantageous as it reduces the cycle time required to produce the lead.

SUMMARY OF THE INVENTION

With respect to the above mentioned disadvantages, the object of this invention is to produce a multi color wire marker that can be easily interfaced with a standard lead-making device and that can simultaneously color mark the wire during the lead making process.

The above mentioned objects have been accomplished by providing a multi color wire marker that has a base to which is movably mounted a carrier of colored tapes, the carrier indexably movable with respect to the wire such that any of the colored products may be deposited on the wire in a repeatable and predetermined position.

DETAILED DESCRIPTION OF THE PREFERRED EMBODIMENT

Figure 1:
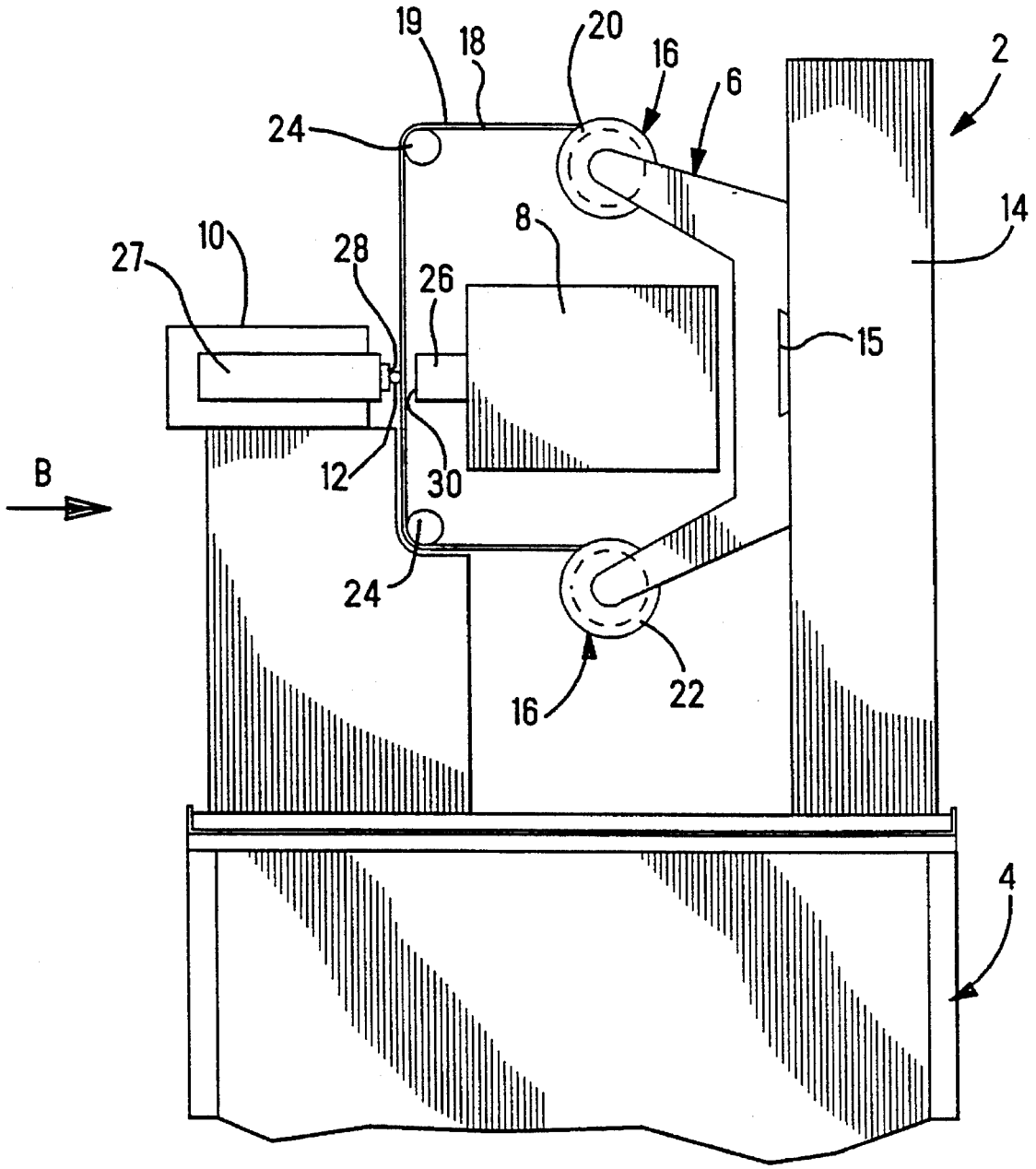
FIG. 1 is a side view of a multi color wire marker.

With reference to FIG. 1 a multi color wire marker is shown generally at 2, comprising a base 4, a carriage housing 6, a ram housing 8, and an anvil 10. A wire 12 to be color marked is shown lying against the anvil 10.

Figure 2:
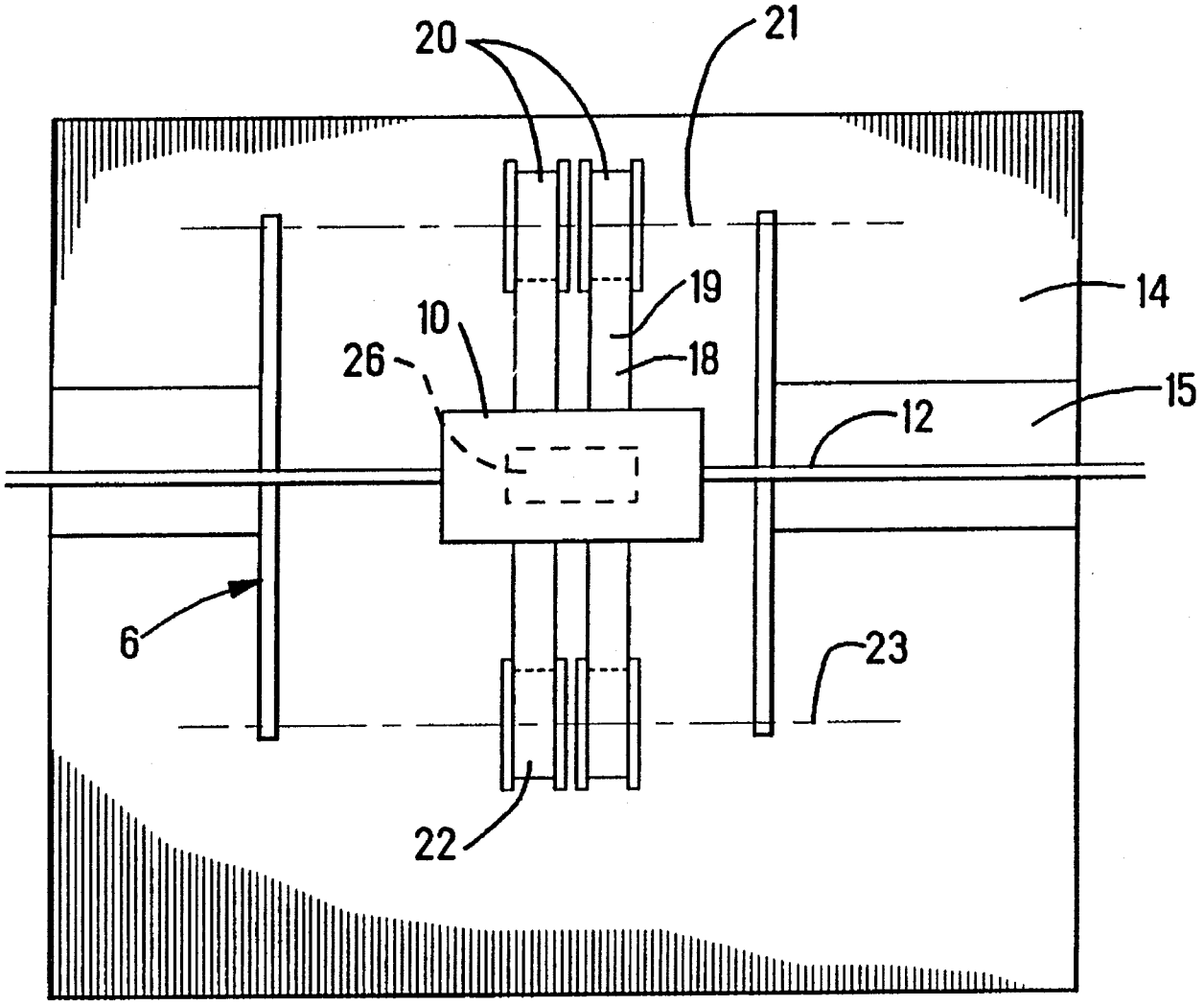
FIG. 2 is a view in the direction B of parts of the multi color wire marker of FIG. 2.

The base 4 has a slideway 14 onto which the carriage 6 is slidably mounted by way of a slide 15, the movement and positioning of the carriage housing 6 is driven respectively by a motor and index mechanism (not shown), such that the carriage housing can move towards and away from the plane of the paper, as viewed in FIG. 1. The carriage housing 6 has a plurality of rollers 16, onto each of which is rolled a long strip of different colored hot foil tape 18. The plurality of rollers 16 comprises two rows of rollers between which the tape 18 is held spanning the wire 12 and anvil 10, an upper row of feed rollers 20 and a lower row of waste rollers 22. For each feed roller 20 there is a corresponding waste roller 22, the plurality of feed rollers and their corresponding waste rollers aligned respectively along axes 21 and 23 as shown in FIG. 2. The individual pairs of feed rollers 20 and corresponding waste rollers 22 are individually indexably rotatable such that the tape 18 corresponding to one pair of rollers 20,22 can be fed independently of the other tapes (the drive mechanism of the rollers is not shown).

The tape 18 has on its front side a colored product 19 that can be deposited on the wire 12 to be marked. Unused tape 18 is fed from the feed roller 20 to the corresponding waste roller 22 that gathers the tape 18 that has already been used for marking the wire 12, whereby only the tape 18, that has been used for marking, is indexably fed by its corresponding rollers 20, 22. Pairs of tensioning bars 24 make sure the tape 18, spanning the wire 12 and anvil 10 between the feed roller 20 and the waste roller 22, is kept under constant tension, which is especially important for feeding, guiding and marking without danger of breaking the tape 18. The tension bars 24 are resiliently biased against the back side of the tape 18 and this resilience force can be adjusted thereby enabling optimal tensioning of the tape 18.

Still with reference to FIG. 1, the ram housing 8 which is supported in a static relation to the base 4, has a ram 26 that is adjustably heated to a predetermined temperature, the ram 26 movable against the back side of the tape 18 such that the tape 18 is pressed against the wire 12. The anvil 10 has a piston 27 having a front surface 28 that opposes a front surface 30 of the ram 26, the wire 12 resting against the surface 28 of the anvil 10. The anvil 10 is fixed to the base 4 and serves to counteract the pressure that the ram 26 applies to the wire 12 through the tape 18, this pressure being suitably controlled by the piston 27. The heat and pressure applied to the tape 18 against the wire 12, causes the colored product 19 mounted on the front side of the tape to melt off and deposit onto the wire 12, thereby marking it with a color. For optimum marking of the wire 12, the temperature and the time under which the wire 12 and hot foil tape 18 are subject to pressure, is adjustable by means within the ram housing 8 (not shown).

To mark the wire 12 with a predetermined color, the appropriate tape 18 must first be moved to a position where it is in between the anvil front surface 28 and the ram front surface 30. Any one of the different colored tapes 18 which are mounted on the rollers 20, 22 one next to the other, is movable to the marking position between the front face 28 of the anvil and the front face 30 of the ram by translation of the carriage housing 6 along the slide 15, whereby an index mechanism ensures that the chosen colored tape 18 is precisely positioned between the face 28 and 30 for marking. In the embodiments herein described, the wire 12 is held straight along the portion to be marked, and the tape carriage housing 6 moves along the slide 15 parallel thereto.

Figure 4:
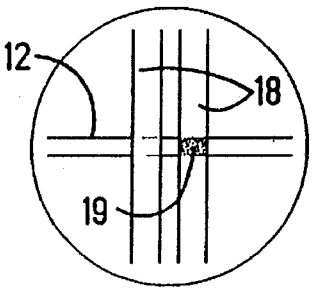
FIG. 4 is a detailed view similar to FIG. 3 of single stamping.
Figure 3:
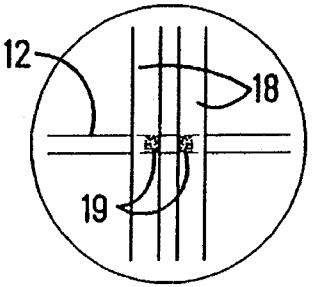
FIG. 3 is a detailed view of an example of double stamping marking colors to a wire.

In the preferred embodiment the wire 12 can be marked with one color by single stamping as shown in FIG. 4 or by two colors from directly neighbouring tapes in double stamping as shown in FIG. 3. For single stamping, the corresponding tape 18 is indexed to a central position along the width of the ram front face 30, but for double stamping the corresponding two neighbouring tapes 18 are moved to a central position along the width of the ram front face 30. The width of the ram 26 is such that it extends over not only the gap separating two neighbouring tapes 18, but also a portion of both tapes 18, thus making double stamping possible.

Figure 6:
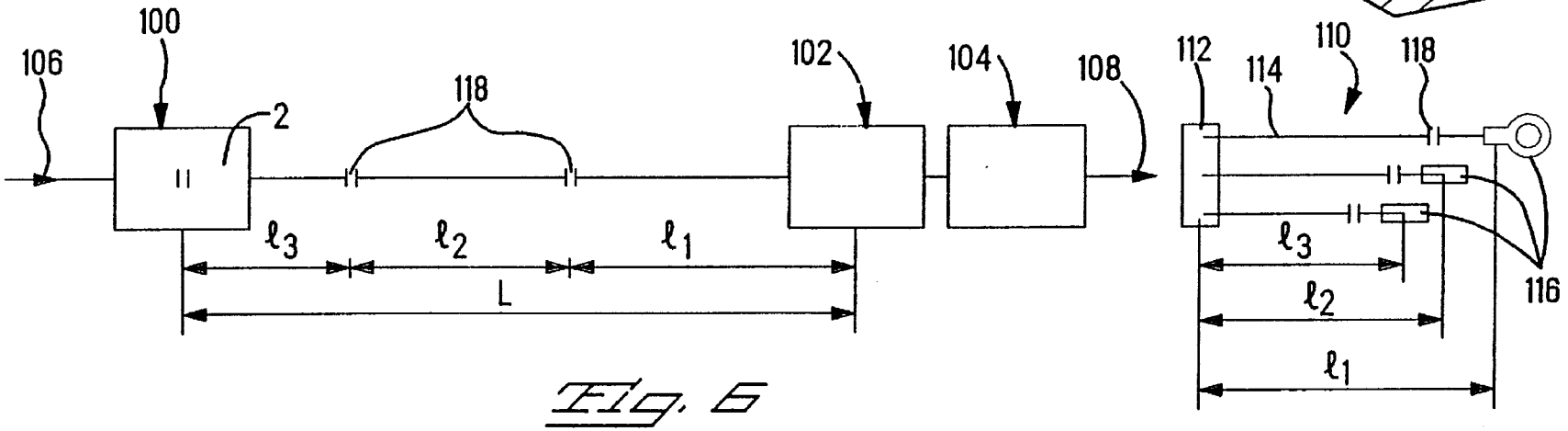
FIG. 6 is a schematic block diagram illustrating the disposition of the lead making machine.

Referring to FIG. 6, a schematic block diagram of a lead making machine is shown with a marking station 100, a wire striping and crimping station 102 and an insulation displacement contacting (IDC) station 104. The wire for making the lead enters at an end 106 proximate the wire marking station 100 and the completed harness exits at another end 108 proximate the insulation displacement contacting section 104. A hybrid harness is generally shown at 110 comprising an insulation displacement connector 112, conducting wires 114 and crimped electrical terminals 116 at another end of the wires 114 than the connector 112. The harness making machine 100, 102, 104 is set up for producing a hybrid connector such as the connector 110 whereby a plurality of leads 114 are connected to a connector 112 having insulation displacement (IDC) terminals therein and at the other end crimped to various terminals 116, the individual leads 114 of various lengths. The individual crimped terminal ends 116 are marked 118 for identification.

One of the prior art solutions for marking the leads 114 is to have a mono-colored marker station 100 that marks the leads alphanumerically. It has been found, however, that it is difficult to distinguish between the leads without alphanumerical marking thus rendering connection of the terminals 116 tiresome and prone to error. Color markings are a lot easier and quicker to distinguish and it is therefore advantageous to provide color marking of the wires as opposed to alphanumerical marking. The marking station 100 of the preferred embodiment of this invention therefore comprises the color marker 2 as described above.

The multi color wire marker 2 is positioned from the stripping and crimping station 102 at a distance L which is substantially equivalent to the sum of the lead lengths 114 of the harness 110 to be produced by the machine. The producing of the hybrid harness 110 will now be described. A single mono-colored wire is fed from the entry end 106 past the multi color wire marker 2, through to the stripping and crimping station 102. For the purposes of simplicity, we shall assume that the hybrid harness to be produced comprises three leads 114 of lengths $l_1$, $l_2$ and $l_3$ respectively. At the stripping and crimping station 102, the wire is stripped of a part of its insulation and crimped to a terminal 116, and simultaneously the wire is color marked at the station 100. The wire is then advanced by a length $l_1$, corresponding to the length of the first lead, and then cut whereby the lead $l_1$ is transported to the IDC station 104 and the other end terminated to an IDC terminal of the connector 112; and simultaneously the new end of the wire is stripped and crimped to a terminal 116 at the station 102 and the wire is color marked at the station 100. The wire is then advanced by a length $l_2$ whereby the same process as described above recommences followed by the next step which advances the cable by the length $l_3$. The harness 110 is thus completed and ejected from the machine at the end 108. The whole cycle recommences with the machine successively moving the wire by the lengths by the lengths $l_1$, $l_2$ and $l_3$. As the wire is marked from a distance L from the stripping, crimping and cutting station 102 in successive steps corresponding to the lead lengths $l_1$, $l_2$ and $l_3$, the color mark 118 is always situated proximate the crimped terminal end 116 of the harness 110. It should be understood that the very first harness produced by the process described above will not be marked as the marking only starts for the second harness that is produced; this is of course of not much importance as the process is a continuous one.

Advantageously therefore, a harness 110 can be produced with leads 114 of mono-colored wire having rapid and easily identifiable color markings at free ends 116 thereof. The color marking machine 2 can also be easily interfaced with a standard lead making machine 102, 104 without increasing the lead production cycle time as the color marking occurs during the stripping and crimping stop time of the wire.

Figure 5:
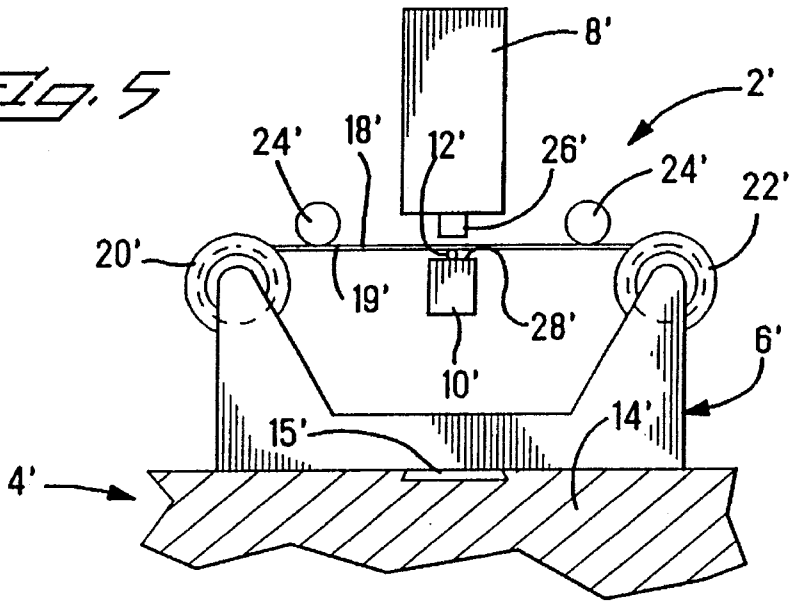
FIG. 5 is a side view of another embodiment of the multi color wire marker.

It should be appreciated that the multi color wire marker 2 as described herein is only representative of the preferred embodiment of the invention and should not be limiting to the claimed invention. More specifically, the disposition of the carriage housing 6 with respect to the slide way 14 as well as the disposition of the anvil 10, the ram housing 8 and the tension bars 24 can be imagined in many different ways, an example of which is shown in FIG. 5 where the same parts as corresponding to FIG. 1 are denoted by the same number with a prime.

I claim:

1. A multiple color wire marker and an associated longitudinally extending wire to be color marked, characterized in that the multiple color wire marker has a base to which is movably mounted a carrier of a plurality of depositable colored products, the carrier indexably movable along the wire such that any of the colored products may be deposited thereon in a predetermined position, whilst the portion of wire to be marked is held in a static relation to the base.

2. The marker of claim 1 characterized in that a portion of the wire to be marked is held straight and static with respect to the base, and the direction of the carrier movement is parallel to the wire, the colored products being disposed on the carrier side by side along an axis parallel thereto.

3. The marker of claim 1 or 2 characterized in that the marker base has a slideway firmly attached thereto, the slideway having a slide to which the carrier is mounted such that the carrier can slideably move therealong.

4. The marker of claim 3 characterized in that the marker has an anvil against which the wire lies so that a heated ram movable towards the anvil, can apply pressure and heat through a hot foil tape upon which one of the depositable colored products is mounted, to the wire against the anvil such that the heat and pressure on the tape through to the wire cause the colored product to dismount from the tape and melt onto the wire.

5. The marker of the claim 4 characterized in that the anvil has a piston to suitably control the pressure applied on the wire against the ram.

6. The marker of claim 4 characterized in that each of the colored tapes are fed off respective feed rollers that are individually indexable so that after each marking cycle of the ram only the one or more colored tapes that have been used to mark the wire are individually indexably fed, the used gathered by a waste roller.

7. The marker of claim 4 characterized in that adjustable tension bars spanning the tape across the wire, maintain an adjustable and approximately constant tension on the colored tape during marking of the wire therewith.

* * * * *